US005732316A

United States Patent [19]

Yamasaki et al.

[11] Patent Number: 5,732,316

[45] Date of Patent: Mar. 24, 1998

[54] IMAGE FORMING APPARATUS PROVIDED WITH MOLD RELEASING AGENT COATING STRUCTURE

[75] Inventors: Hiroyuki Yamasaki, Amagasaki; Masahide Ueda, Takatsuki; Yoshihisa Terasaka, Suita; Eiichi Sano; Masahiko Matsuura, both of Takatsuki; Atsuto Hirai, Ikoma; Tomoo Izumi, Amagasaki; Masami Yamada, Osaka, all of Japan

[73] Assignee: Minolta Co., Ltd., Osaka, Japan

[21] Appl. No.: 364,759

[22] Filed: Dec. 27, 1994

[30] Foreign Application Priority Data

Dec. 27, 1993 [JP] Japan ..... 5-332889

[51] Int. Cl.[6] ..... G03G 15/20

[52] U.S. Cl. ..... 399/321; 399/67; 399/325

[58] Field of Search ..... 355/282, 284, 355/326 R, 327, 209; 118/60; 399/321, 324, 325, 67

[56] References Cited

U.S. PATENT DOCUMENTS

| | | | |
|---|---|---|---|
| 5,099,289 | 3/1992 | Kurotori et al. | 355/284 X |
| 5,200,786 | 4/1993 | Fromm et al. | 355/284 |
| 5,221,948 | 6/1993 | Dalal | 355/284 |
| 5,374,983 | 12/1994 | Isogai | 399/325 |
| 5,500,722 | 3/1996 | Jacobs | 355/282 X |

FOREIGN PATENT DOCUMENTS

| | | | |
|---|---|---|---|
| 58-215674 | 12/1983 | Japan | 355/284 |
| 61-138977 | 6/1986 | Japan . | |
| 62-164075 | 7/1987 | Japan . | |
| 1-296281 | 11/1989 | Japan . | |
| 4-85577 | 3/1992 | Japan . | |
| 4-333085 | 11/1992 | Japan . | |
| 5-027637 | 2/1993 | Japan | 355/284 |
| 5-150682 | 6/1993 | Japan | 355/284 |
| 5-60106 | 9/1993 | Japan . | |

*Primary Examiner*—S. Lee
*Attorney, Agent, or Firm*—Sidley & Austin

[57] ABSTRACT

An image forming apparatus includes a first developing device, accommodating a first kind of toner without an offset preventing agent, a second developing device accommodating a second kind of toner containing an offset preventing agent, and a roller fixing device having a supply portion for supplying an offset preventing agent. The image forming apparatus changes the amount of the offset preventing agent to be supplied to the fixing roller between the case of fixing a copy image formed with the first kind of toner and the case of fixing a copy image formed with the second kind of toner.

34 Claims, 10 Drawing Sheets

IMAGE FORMING APPARATUS PROVIDED WITH MOLD RELEASING AGENT COATING STRUCTURE

BACKGROUND OF THE INVENTION

1. Field of the Invention

The present invention relates to an image forming apparatus such as a copying machine, a printer or the like for forming an image by using a toner.

2. Description of the Related Art

Generally, in an image forming apparatus, such as a copying machine or a printer based on electrophotography, an image is formed by developing an electrostatic image using a toner. The toner image is then transferred onto a recording medium, pressed by a pressing member, such as a roller, and pressurized and heated for fixation on the recording medium.

In order to prevent adhesion of toner to the pressing member for fixation, that is, generation of offset, an offset preventing agent such as a polyolefine based wax is added to the toner. The method of preventing offset by adding offset preventing agent to the toner is advantageous in that it is very easy.

Conventionally, a single color image forming apparatus for forming black and white images only have been proposed. Recently, however, an image forming apparatus such as a color copying machine or a color printer has come to be practically used, in which color images are formed by overlapping toner images of three or four colors formed by toners of three different colors, that is, yellow, magenta and cyan, or four toners additionally including black. A color copying machine will be described in the following as an example.

The yellow, magenta, cyan and black toners used in the aforementioned color copying machine must allow color representation by overlapping, and the toner must have light permissivity when images are formed on a transparent film for an OHP (Over Head Projector), for example. As offset preventing agents have poor dispersion properties, other toner components cannot be added; Therefore, generally, in the aforementioned color copying machine, generation of an offset is prevented by applying a mold releasing agent such as a silicone oil on the pressing member for fixation. The black toner used for color image forming is one which is black in color and prepared by blending coloring agents of yellow, magenta and cyan appropriately, and it does not contain the offset preventing agent. This toner will be hereinafter referred to as black toner for color image forming, and it is distinguished from the black toner for black and white image forming which contains the offset preventing agent.

When a black and white copying operation is to be performed by the color copying machine, such as in the case of copying a black and white original, or in a case a black and white copy image is to be obtained from a color original, the black image is obtained by overlapping yellow toner, magenta toner and cyan toner; by using black toner for color image formation; or by both overlapping color toners and using the black toner for color image forming.

However, the toners for color image forming are more expensive as compared with the black toner for black and white image forming. This is because coloring agent of yellow, magenta and cyan contained in the toners for color image forming are expensive as compared with the black coloring agent used in the black toner for black and white image forming. Therefore, black and white copying operation by a color copying machine is disadvantageous in view of cost.

Accordingly, the cost for copying can be reduced by providing, in a color copying machine, a developing unit for black and white image forming in which developing is performed by using black toner for black and white image forming containing the offset preventing agent, in addition to developing units for color image formation consisting of three developing units respectively containing yellow toner, magenta toner and cyan toner not including the offset preventing agent, or consisting of four developing units including the aforementioned three developing units plus a developing unit containing black toner for color image forming, and by performing black and white copying using the developing unit for black and white image forming.

However, in such case, the color copying machine contains both the black toner for black and white image forming containing the offset preventing agent, and the toner for color image forming not containing the offset preventing agent. Therefore, even in the case of black and white copying using the black toner for black and white image forming containing the offset preventing agent which does not require application of the mold releasing agent, the mold releasing agent may be applied, resulting in unsuccessful black and white image formation. Alternatively, it may be possible that when a color image is to be formed by using toner for color image formation not containing the offset preventing agent in which application of a mold releasing agent is indispensable, the mold releasing agent is not applied, resulting in generation of an offset.

SUMMARY OF THE INVENTION

An object of the present invention is to enable satisfactory fixation of toner, in an image forming apparatus capable of selectively forming images by using a plurality of toners containing different amounts of offset preventing agent.

Another object of the present invention is to prevent unnecessary consumption of mold releasing agent.

A still further object of the present invention is to provide an image forming apparatus capable of forming color images and black and white images both of superior quality.

A still further object of the present invention is to provide a color image forming apparatus of which cost for image forming is suppressed.

The foregoing and Other objects, features, aspects and advantages of the present invention will become more apparent from the following detailed description of the present invention when taken in conjunction with the accompanying drawings.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
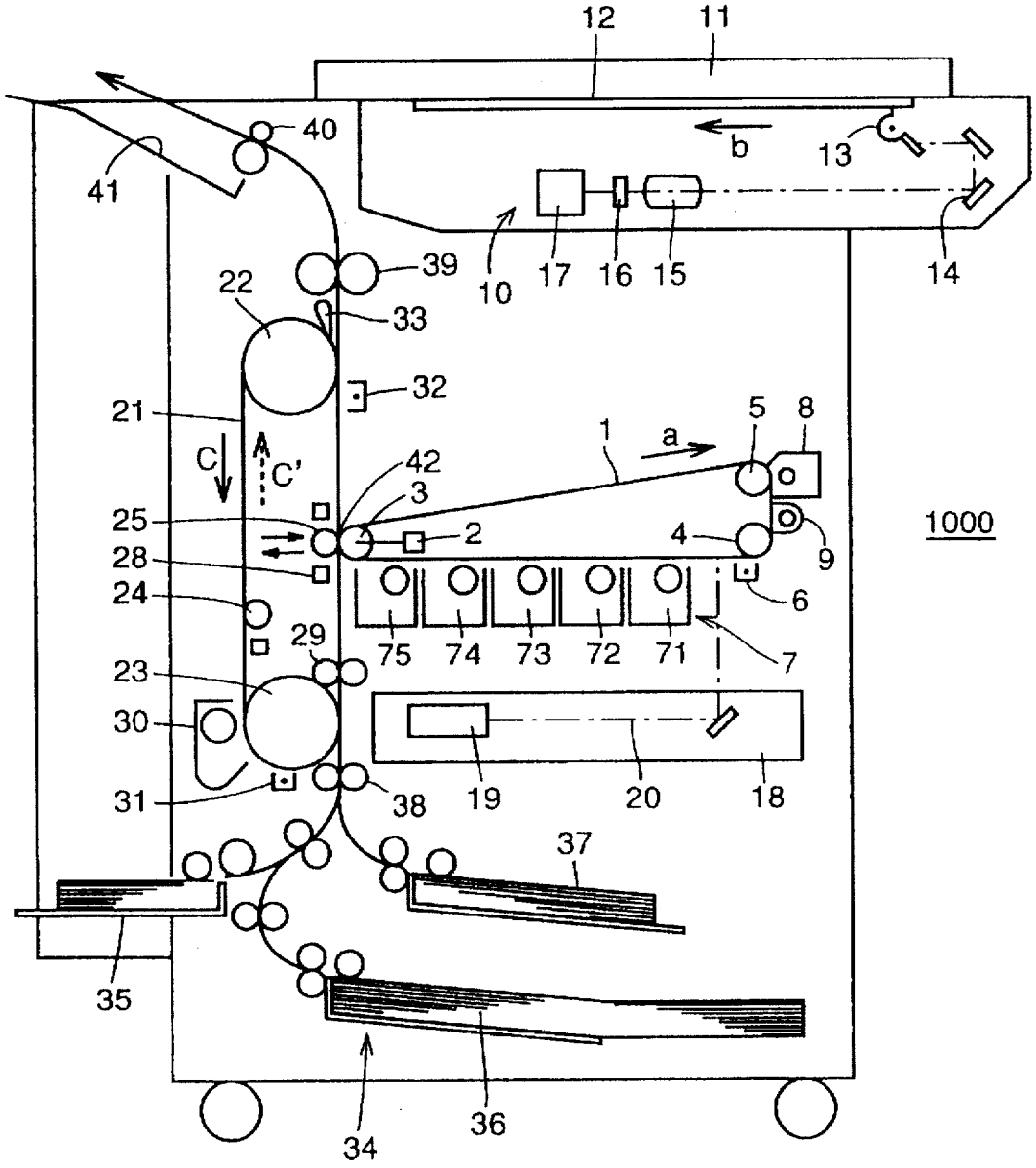
FIG. 1 is a cross sectional view schematically showing the structure of a multi-color copying machine.

FIG. 1 schematically shows the structure of a multicolor copying machine 1000 to which the present invention is applied. A photoreceptor 1, which is an endless belt having a photoreceptor layer on its outer circumferential surface, is wound around a roller 3 which includes a rotation detection sensor 2 and rollers 4 and 5. Photoreceptor 1 and moves in the direction of arrow a by the rotation of roller 3. Disposed around photoreceptor 1 are a corona charger 6, developing units 7, a cleaning device 8, and an eraser lamp 9. Developing units 7 include first developing unit 71, second developing unit 72, third developing unit 73, and fourth developing unit 74, fifth developing unit 75, which accommodate developers of yellow, magenta, cyan, black for color image forming and black for black and white image forming, respectively, and are switchable between a developing state and a non-developing state.

An image reading device 10 is disposed under a document station glass 12 covered with an openable cover 11 at the top. A document illumination lamp 13 illuminates a document placed on document station glass 12 while moving in the direction of arrow b. Light reflected from the document is read as color signals of three primary colors at a line sensor 16 through a mirror system 14 and a lens system 15, and output to an image processing circuit 17.

An image exposure device 18 includes a laser emission device 19. Laser emission device 19 emits a laser beam 20 based on an output from image processing circuit 17. The outer circumferential surface of photoreceptor 1 is exposed to laser beam 20 from between corona charger 6 and developing units 7, accommodating two-component developers.

As a rotary transfer body, transfer belt 21 is wound around a driving roller 22 and a driven roller 23 disposed thereunder and has its belt tension adjusted by a tension roller 24. A transfer roller 25, movably supported toward/away from roller 3, is disposed inside transfer belt 21, and transfer roller 25 contacts/separates transfer belt 21 to/from photoreceptor 1. Also inside transfer belt 21, sheet detection sensors 28 are provided in the vicinity of tension roller 24 and above and under transfer roller 25, respectively. Under transfer roller 25, a pair of assist rollers 29 are provided for closely contacting a sheet to the outer circumferential surface of transfer belt 21. Outside transfer belt 21, a belt cleaner 30 facing a portion of the belt wound around driven roller 23, a corona charger 31, a discharger 32 facing a part of the belt passing a portion opposite to photoreceptor 1, and a separation nail 33 for contacting/separating to/from the portion of the belt wound around driving roller 22 are provided.

A paper feeding device 34 includes three paper feeding portions 35, 36 and 37. Sheets housed at paper feeding portions 35, 36, and 37 are selectively supplied onto transfer belt 21 in synchronization with a toner image formed on photoreceptor 1 by a timing roller 38.

A fixing device 39 and discharge rollers 40 are provided above transferred belt 21, and a sheet-passed through fixing device 39 is discharged onto a discharge tray 41 by discharge rollers 40. The structure of fixing device 39 will be later described in more detail.

Figure 2:
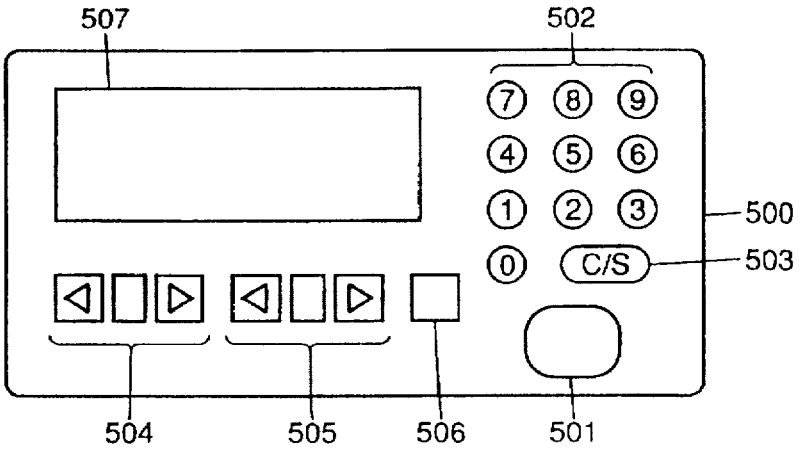
FIG. 2 is a view schematically showing an operation panel in a copying machine.

FIG. 2 is a view schematically showing an operation panel provided at the top of the color copying machine shown in FIG. 1. As illustrated in FIG. 2, operation panel 500 provides a print key 501 for initiating a copy operation, a ten key 502 for inputting numbers such as the number of copies required, a clear/stop key 503 for instructing clearing of an input number and stopping copy operation, a mode designation key 506 for switching between a color copying mode and a black-and-white copying mode, a copying magnification designation key 504 for designating a copying magnification, a density key 506 for designating a copying density, and a message display 507 for displaying copying conditions or the like.

Figure 3:
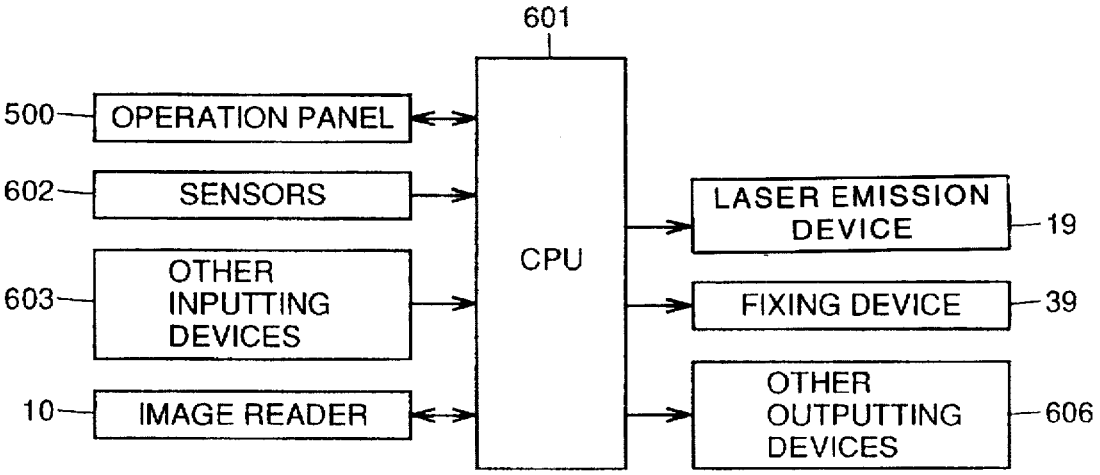
FIG. 3 is a block diagram showing a control circuit in a copying machine.

FIG. 3 is a block diagram showing a control circuit for the copying machine shown in FIG. 1. As illustrated in FIG. 3, the control circuit is constructed around a CPU (Central Processing Unit) 601. CPU 601 is connected to various devices for forming images, such as, image reading device 10, image exposure device 18, paper feeding device 34, developing units 7, fixing device 39, driving roller 3 for photoreceptor 1, and driving roller 22 for transfer belt 21. CPU 601 outputs signals to the devices in order to control their operations. CPU 601 is provided with a signal from each key on operation panel 500, a read signal from image reading device 10, a signal from each sensor 602 and signals from other input devices 603. CPU 601 determines copying conditions or the like based on these input signals and timely output signals to the devices.

CPU 601 switches the copying mode from the color copying mode, to the black-and-white copying mode or vice versa, in response to an input from mode designation key 506. In this embodiment, a toner for color copying without an offset preventing agent is used for color copying, and a toner for black and white copying containing an offset preventing agent is used for black-and-white copying. An oil application mechanism, which will be described later, can be controlled in response to a switching between the color copying mode and the black-and-white copying mode, wherein the amount of oil to be applied to the fixing roller can appropriately be changed.

A multi-color copying operation by the multi-color copying machine will now be described. A copying document is placed on document station glass 12, with document cover 11 placed thereon.

When print key 501 is pressed down, document illumination lamp 13 illuminates the document while moving in the direction of arrow b in image reading device 10. Light reflected therefrom comes into mirror system 14 and lens system 15, and is read as three primary color signals by line sensor 16. The color signals are converted into a quaternary signal representing yellow, magenta, cyan and black at image processing circuit 17, and the output signal is provided to image exposure device 18.

In image exposure device 18, based on the above output signal, laser beam 20 corresponding to a yellow image is emitted, then laser beam 20 corresponding to a magenta image is emitted, followed by laser beam 20 corresponding to a cyan image, and finally laser beam 20 corresponding to a black image. The timing for emitting each laser beam 20 will be described later.

Photoreceptor 1 moves in the direction of arrow a by the rotation of roller 3, and is charged by application of charges at a prescribed potential to its outer circumferential photoreceptor layer at the portion opposing corona charger 6. Thus, charged photoreceptor 1 is irradiated with laser beam 20 emitted from image exposure device 18, and latent electrostatic images of different colors are sequentially formed on its outer circumferential surface. The latent electrostatic images of the respective colors are formed into visible toner images by first developing unit 71, second delevoping unit 72, third developing unit 73 and fourth developing unit 74, having corresponding colored developers. Note that a rotation of photoreceptor 1 is detected in response to a pulse signal generated by rotation detection sensor 2 every time roller 3 makes a rotation. Laser beam 20 is emitted from image exposure device 18 in a timing according to a pulse signal.

Transfer belt 21 moves in the direction of arrow c by the rotation of driving roller 22, which is started in response to an ON signal from print key 501. Transfer belt 21 its surface cleaned by belt cleaner 30, and is then charged to a prescribed potential by corona charger 31. Meanwhile, a sheet sent out from paper feeding portion 35, 36, or 37 stops at the position of timing roller 38. The sheet is then electrostatically attracted to the outer circumferential surface of transfer belt 21 in timing with a toner image formed on photoreceptor 1, and is passed between assist roller pair 29 and surely held by the belt.

The sheet held by transfer belt 21 is conveyed in the direction of arrow c with the movement of transfer belt 21, and when a tip end of the sheet is detected by sensor 28, transfer roller 25 moves to the right in the figure and comes into contact with photoreceptor 1. The sheet is conveyed between transfer roller 25 and photoreceptor 1, where a yellow toner image is transferred at the contact position (hereinafter referred to as transfer position to the sheet. The sheet with the yellow toner image transferred thereon is then repeatedly conveyed to transfer position 42 in timings with magenta, cyan, and black toner images, and these toner images are combined.

Discharging charger 32, weakening the attractive electrostatic force between the sheet and transfer belt 21, the sheet with the toner images of all the colors transferred thereon is separated from transfer belt 21 by separation nail 33. Then, the toner images are heated for fixation at fixing device 39, and the sheet is discharged onto discharge tray 41 by discharge rollers 40. Meanwhile, the outer circumferential surface of photoreceptor 1, removed of the toner images at the transfer position 42, is cleaned with cleaning device 8, and subjected to eraser lamp 9 to remove any remaining charges.

Note that the case in which only a single sheet is held at transfer belt 21 has been described, but a plurality of sheets may be held at a time at transfer belt 21.

When a color image is to be formed on an OHP (Over Head Projector) sheet, toner images of respective colors may be successively overlapped with the OHP sheet held on transfer belt 21 and the position of transfer moved reciprocally, since the OHP sheet on transfer belt 21 is more easily shifted in position than the ordinary sheet.

Figure 4:
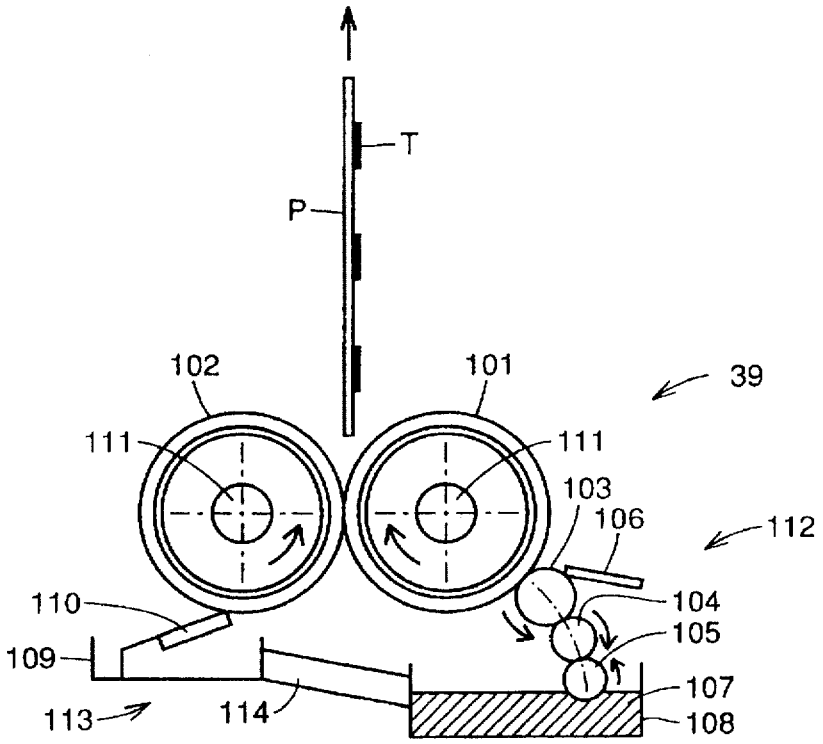
FIG. 4 is a cross sectional view showing an essential part of a copying machine when oil for a fixing device is supplied.

The fixing device will now be described. FIG. 4 is a cross sectional view showing an essential part of fixing device 39. Fixing device 39 is a heat fixing type with a heat roller. Fixing device 39 includes a fixing roller 101; a pressure roller 102 disposed to pressure-contact fixing roller 101 with a spring or the like under a linear load of 2 Kg/cm; heaters 111 disposed in fixing roller 101 and pressure roller 102, an oil application device 112 for contacting fixing roller 101 for application of mold releasing oil (silicone oil) 107; and an oil recycle device 113 for collecting mold releasing oil 107 applied on pressure roller 102 for supply to oil application device 112.

Fixing roller 101 and pressure roller 102 are formed by covering an aluminum core metal with silicone rubber. Instead of silicone rubber, another elastic body such as of a fluorine based polymer compound, PTFE (polytetrafluoroethylene) or PFA (perfluoroalkylvinylether copolymer), for example, may be used to coat the core metal.

Oil application device 112 includes an oil application roller 103, formed by covering an aluminum core metal with an elastic body such as silicone rubber; an aluminum intermediate roller 104 in contact with oil application roller 103, an aluminum supply roller 105 in contact with intermediate roller 104 and soaked in mold releasing oil 107; an oil regulating blade 106 of stainless steel which is in pressure-contact with oil application roller 103; and an oil pan 108 storing mold releasing oil 107 for supplying the oil to supply roller 105.

Figure 5:
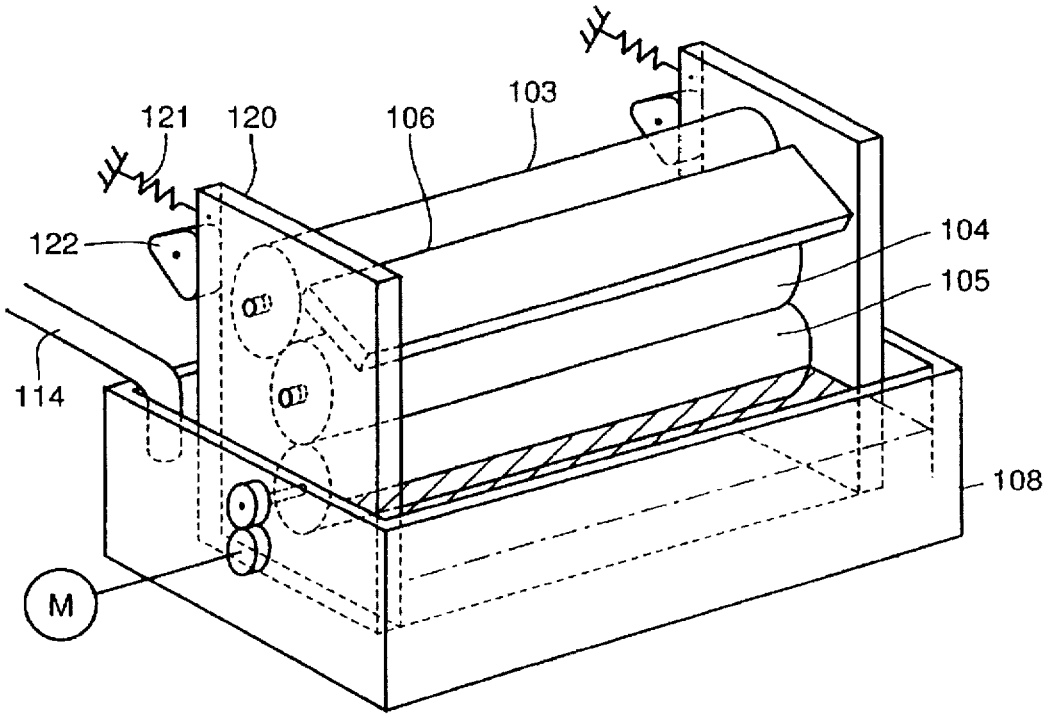
FIG. 5 is a perspective view showing in detail the structure of an oil application device.

FIG. 5 is a perspective view showing in detail the structure of oil application device 112. As illustrated in FIG. 5, oil application roller 103, intermediate roller 104, supply roller 105 and oil regulating blade 106 are integrally held by a support plate 120. Support plate 120 is swingably supported around the axis of support roller 105. Support plate 120 is biased toward fixing roller 101 by the function of a pair of springs 121. A pair of cams 122 abut upon a surface of support plate 120 facing fixing roller 101.

The pivot of cams 122 swings support plate 120, by which oil application roller 103 and fixing roller 101 are pressure-contacted/separated.

Oil application device 112 is controlled by the CPU to separate oil application roller 103 from fixing roller 101 during non-copying and black-and-white copying.

Referring back to FIG. 4, oil recycle device 113 includes an oil collection blade 110 for collecting mold releasing oil 107 applied on pressure roller 102, a collection oil pan 109 for temporarily storing thus collected mold releasing oil 107, and a conduit 114 for supplying collected mold releasing oil 107 from collection oil pan 109 to oil pan 108. Note that conduit 114 is provided to avoid a paper path so as not to prevent passage of sheets.

When the power supply switch (not shown) of multicolor copying machine 1000 is operated to turn on the power supply, heater 111 conducts and a warm-up of fixing device 39 is initiated. When the warm-up is completed, and color copying is instructed, for example, oil application roller 103 is pressure-contacted to fixing roller 101. Then, when a fixing operation is initiated, fixing roller 101 is driven to rotate by a motor (not shown). Fixing roller 101 and pressure roller 102 are linked with each other by means of a gear, and fixing roller 101 is driven to rotate clockwise and pressure roller 102 is driven to rotate anticlockwise. As oil application roller 103, intermediate roller 104 and supply roller 105 are linked by means of a gear, the same motor drives oil application roller 103 to rotate anticlockwise, intermediate roller 104 to rotate clockwise and supply roller 105 to rotate anticlockwise. -At the time, since supply roller 105 is soaked in mold releasing oil 107, mold releasing oil 107 reaches to intermediate roller 104 by supply roller 105. Then, mold releasing oil 107 reaches oil application roller 103 from intermediate roller 104. Finally, the amount of oil is regulated uniformly in a small amount by oil regulating blade 106 at the surface of oil application roller 103, and applied onto the surface of fixing roller 101. Then, a recording medium P with a toner image T transferred thereon passes between fixing roller 101 and pressure roller 102 and toner image T on recording medium P is melted by the heat and pressure, and fixed onto recording medium P. Mold releasing oil 107 which has been applied onto the surface of fixing roller 101 and not absorbed into recording medium P is applied to pressure roller 102 and collected from the surface of pressure roller 102 by oil collecting blade 110.

Figure 6:
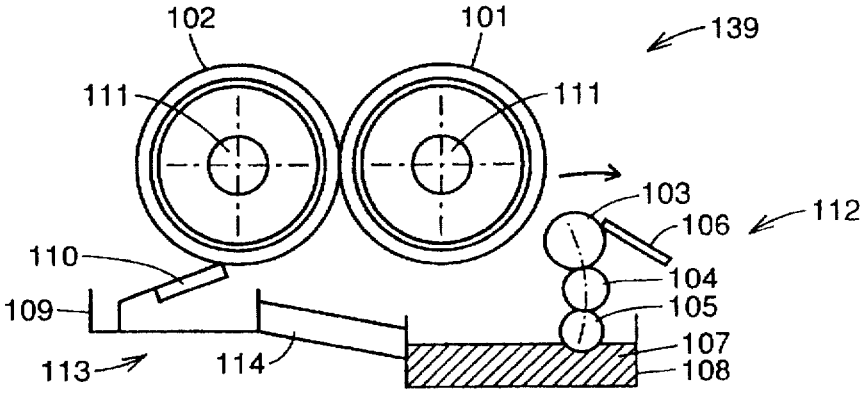
FIG. 6 is a cross sectional view showing an essential part of a fixing device when oil is not supplied.

As described above, at the time of copying a color image, oil application roller 103 is in contact with fixing roller 101, and oil in oil pan 108 is supplied to fixing roller 101 through supply roller 105 and intermediate roller 104. Meanwhile, at the time of copying a black-and-white image, as illustrated in FIG. 6, oil application roller 103 moves away from fixing roller 101, and thus supply of the oil in oil pan 108 to fixing roller 101 is cut off.

Figure 7:
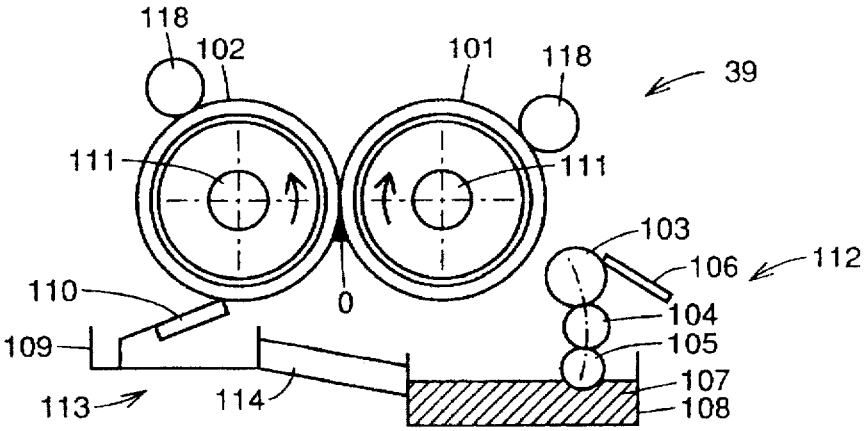
FIG. 7 is a view showing oil gathered in a fixing device.

Note that mold releasing oil 107 which has escaped oil collecting blade 110 sometimes gathers as designated as 0, at the nip portion where fixing roller 101 and pressure roller 102 are in contact with each other (FIG. 7).

Figure 8:
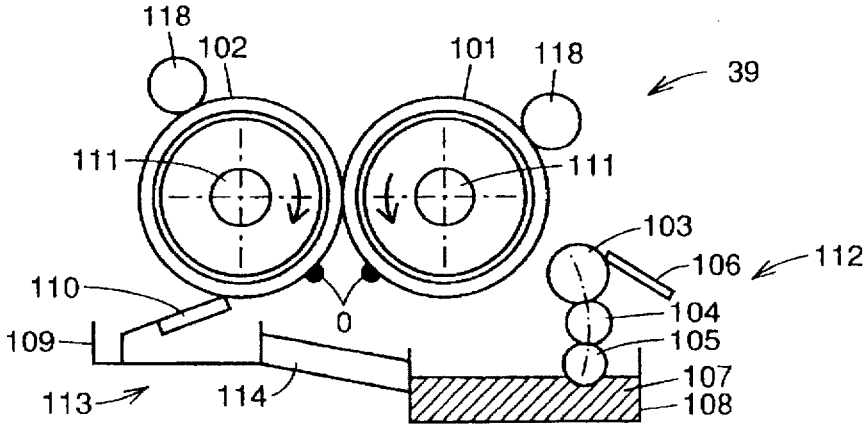
FIG. 8 is a cross sectional view showing an essential part of a variation of a fixing device.

Conducting a following fixing operation in that state could disturb the quality of an image. Therefore, as illustrated in FIG. 8, cleaning rollers 118 may be provided in contact with fixing roller 101 and pressure roller 108, and after a completion of a warm-up, fixing roller 101 is rotated anticlockwise and pressure roller 102 is rotated clockwise, so that the oil 0 gathered at the nip portion can be absorbed by cleaning roller 118.

Figure 9:
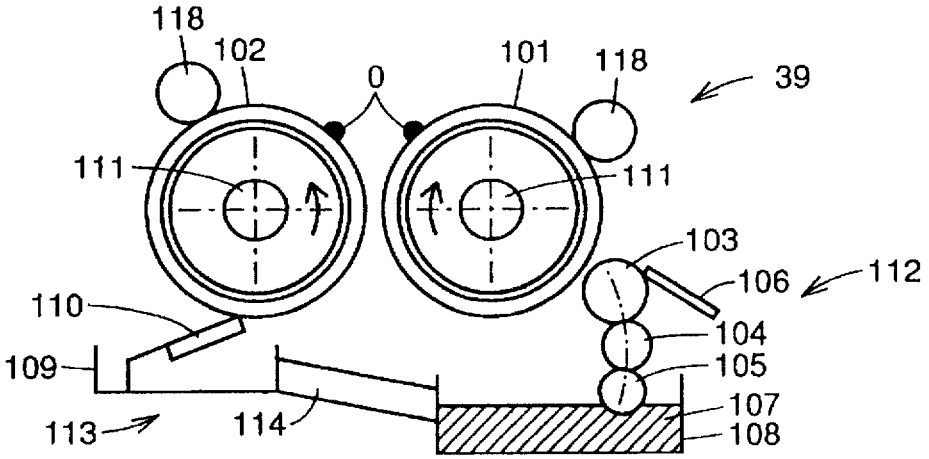
FIG. 9 is a cross sectional view showing an essential part of another variation of a fixing device.

Also as illustrated in FIG. 9, the pressure-contact state of fixing roller 101 and pressure roller 102 may be released in order to remove the oil gathered at the nip portion, and by rotating fixing roller 101 clockwise and pressure roller 102 anticlockwise, the oil 0 gathered at the nip portion may be absorbed by cleaning roller 118.

Figure 10:
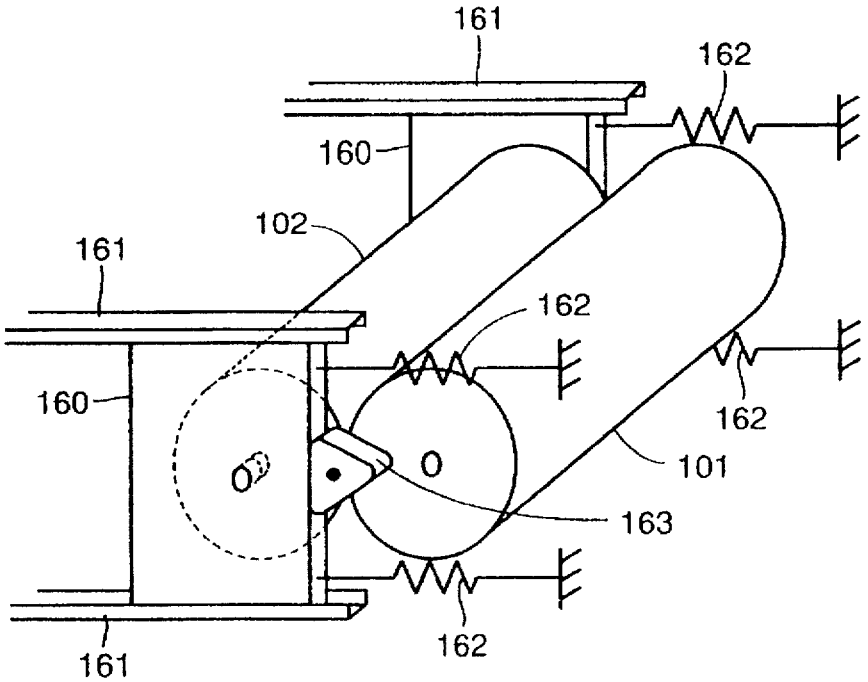
FIG. 10 is a perspective view showing in detail the structure of a mechanism for pressure contacting/separating a fixing roller and a pressure roller.

FIG. 10 is a perspective view schematically showing the structure of a mechanism for pressure-contacting/separating fixing roller 101 and pressure roller 102 in the fixing device shown in FIG. 9. As illustrated in FIG. 10, a pair of support plates 160 supporting both ends of pressure roller 102 are supported movably in the horizontal direction along respective slide ditches 161. Each support plate 160 is biased to pressure-contact pressure roller 102 to fixing roller 101 by the function of a spring 162. A cam 163 abuts upon the side of a support plate on the side of fixing roller 101. The rotation of cam 163 pressure-contacts/separates pressure roller 102 and fixing roller 101.

The structure of the fixing device is not limited to the above and can be modified if necessary. Variations are described in the following.

Figure 11:
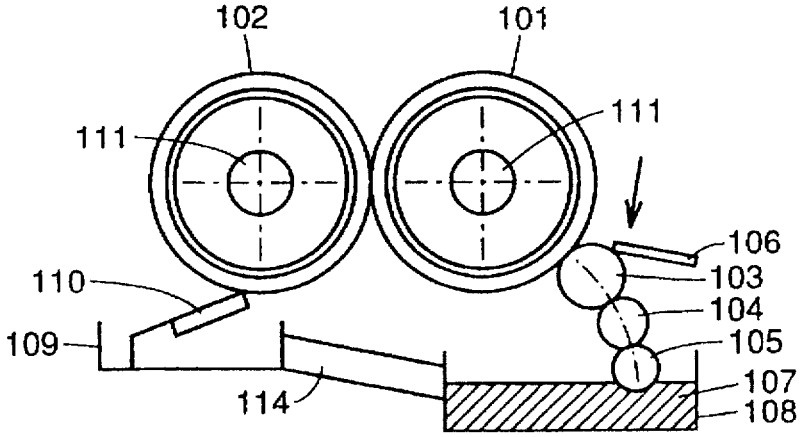
FIG. 11 is a cross sectional view showing an essential part of another variation of a fixing device.

FIG. 11 shows an embodiment in which the amount of mold releasing oil 107 applied onto fixing roller 101 is reduced only when the black-and-white mode is selected as compared to the full color mode is selected. In the following variations, the oil application roller is separated from fixing roller 101 when copying is not conducted. The mechanism for pressure-contacting/separating oil application roller 103 and fixing roller 101 is the same as that shown in FIG. 5, and therefore a detail description thereof will not be provided here.

Figure 12:
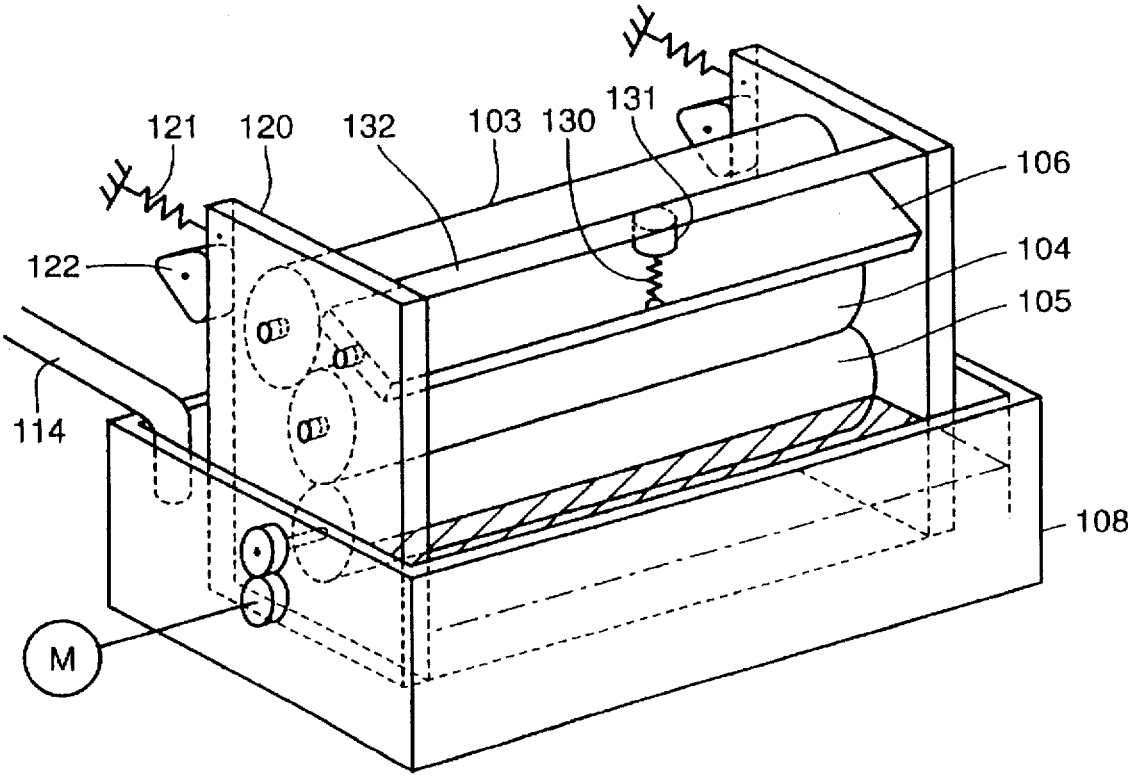
FIG. 12 is a perspective view showing in detail the structure of an oil application mechanism in the fixing device shown in FIG. 11.

In this embodiment, as illustrated in FIG. 11, application roller 103 is pressure-contacted to fixing roller 101 during a copying operation regardless of whether it is a color copying or a black-and-white copying operation. As illustrated in FIG. 12, oil regulating blade 106 is pressure-contacted to oil application roller 103 under a prescribed pressure by the function of spring 130. Spring 130 is connected to a solenoid 131 attached to a plate member 132 provided to support plate 120. In black-and-white copying, the solenoid expands the spring to increase the force of pressure-contacting oil regulating blade 106, thereby reducing the amount of mold releasing oil 107 to be applied.

Figure 13:
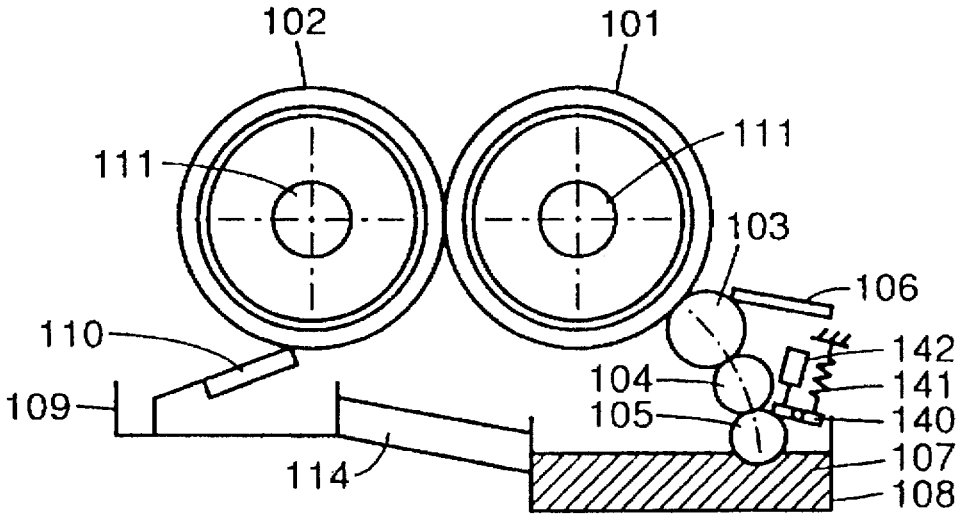
FIGS. 13 to 18 are cross sectional views each showing an essential part of a variation of a fixing device.

FIG. 13 shows a variation with the provision of an oil regulating blade 140 which can be pressure-contacted/separated to/from supply roller 105 in the same structure as the fixing device shown in FIG. 4. First oil regulating blade 106 is always pressure-contacted to oil application roller 103. Second oil regulating blade 140 is swingably supported around its axis, with a solenoid 142 provided at one end and a spring 141 at the other end. Solenoid 142 expands/contracts in response to an instruction from the CPU and swings second oil regulating blade 140. During color copying, second oil regulating blade 140 is separated from supply roller 105, while during black-and-white copying, second oil regulating blade 140 is pressure-contacted to supply roller 105 by the function of spring 141 and the amount of mold releasing oil 107 to be applied is reduced as a result.

Figure 14:
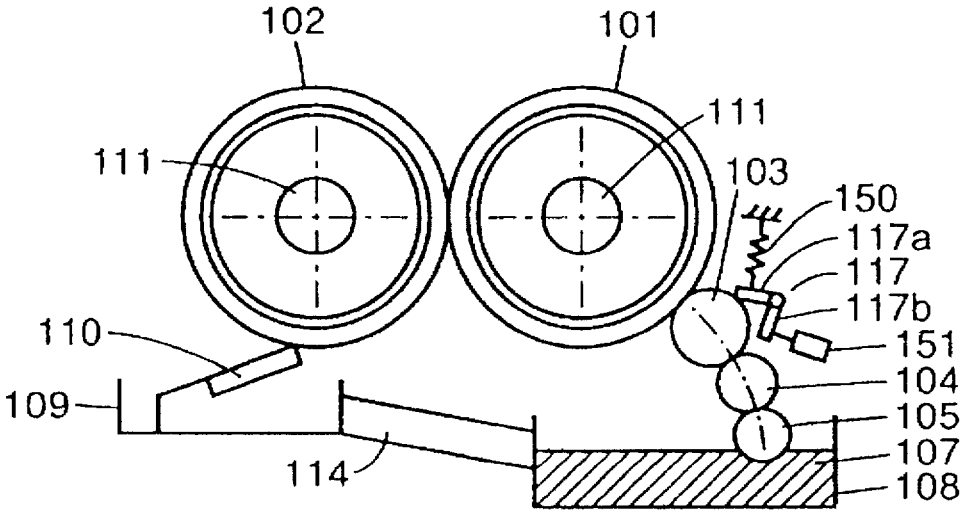

FIG. 14 shows a variation of the fixing device shown in FIG. 4 with an oil regulating blade 117 of a different shape. Oil regulating blade 117 includes two blades **117*a* and 117*b* having different abutting angles to oil application roller 103 and a V-shaped cross section. During color copying, blade 117*a* pressure-contacts roller 103 in a direction following the rotation of the roller. Meanwhile during black-and-white copying, blade 117*b* is pressure-contacted in a direction against the rotation of the roller, so that the amount of mold releasing oil 107 to be applied onto the fixing roller is reduced. Note that blade 117*a* is provided with a spring 150, biasing blade 117*a* away from the oil supply roller, while blade 117*b* is provided with a solenoid 151 to move blade 117*b*, and by the functions of solenoid 151 and spring 150**, the blades are switched.

Figure 15:
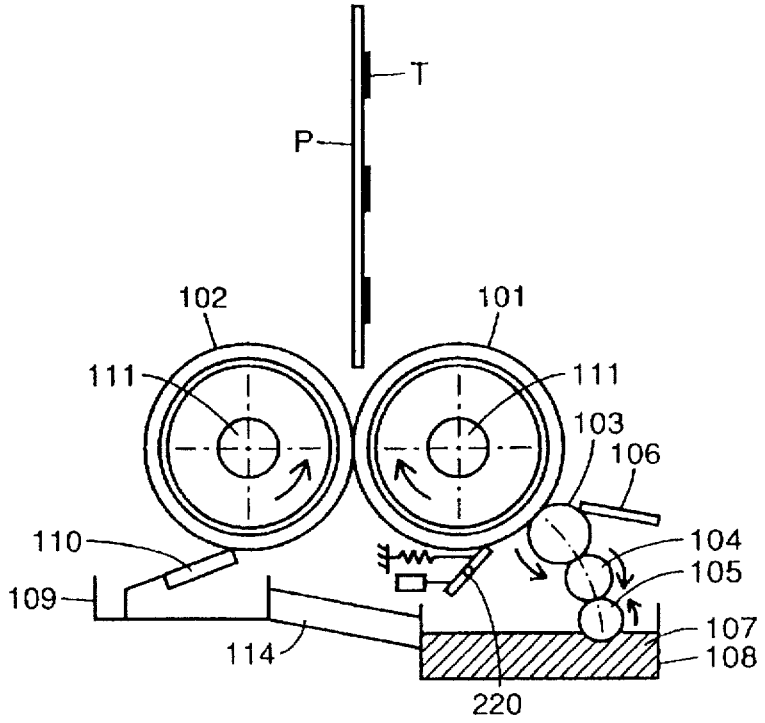

FIG. 15 shows a variation of the same structure of the fixing device shown in FIG. 4 with a scratching blade 220 which can be contacted/separated to/from fixing roller 101. During black-and-white copying, scratching blade 220 is pressure-contacted to fixing roller 101, and catches oil on fixing roller 101 by scratching. During a color copying operation, scratching blade 220 is separated from fixing roller 101, and oil is applied to fixing roller 101.

A color toner is more likely to suffer from an offset phenomenon when fixed at a high temperature and under a high pressure. Therefore, such toner is preferably fixed at a relatively low temperature and under a relatively low pressure. A toner for black-and-white copying is not sufficiently fixed at a low temperature and under a low pressure; therefore, such toner is preferably fixed at a relatively high temperature and under a relatively high pressure. Therefore, fixing device 39 preferably changes at least one of temperature and pressure depending upon a selected copying mode.

In order to change the pressure, for example, as illustrated in FIG. 10, the flexure of the spring which pressure-contacts fixing roller 101 and pressure roller 102 may be changed with a cam.

Figure 16:
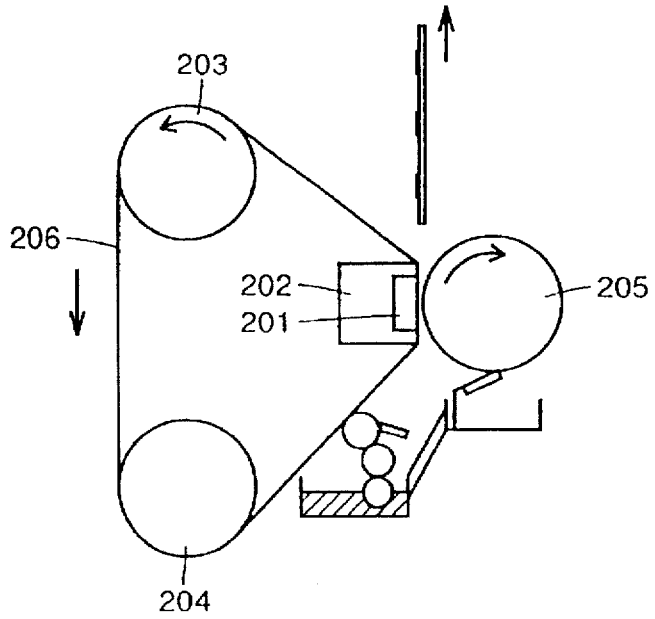

In order to change the temperature, as illustrated in FIG. 16, it is preferable to use a fixing device which employs a method of heating recording medium P through a belt-shaped film, so that the fixing temperature can rapidly be changed for the small heat capacity of the film.

In FIG. 16, an endless belt-shaped fixing film 206 is suspended under tension around driving roller 203, driven roller 204 and heating body 201 supported by support body 202. Film 206 is driven to rotate at a prescribed peripheral speed along with the rotation of driving roller 203. A pressure roller 205 pressure-contacts film 206 in the direction of heat body 201 with film 206 between heat body 201 and itself. A recording medium with a toner image transferred thereon is heated and pressurized between pressure roller 205 and film 206 and conveyed upwardly together with film 206. An oil application device identical to that Shown in FIG. 4 is provided for applying oil to film 206.

Note that the black-and-white mode in this embodiment may have an intermediate mode for copying an image of an intermediate tone, such as a photograph and a character mode for copying a character image. These modes may be automatically or manually set depending on the kind of an image. In the intermediate mode, fixing may be conducted at a higher temperature and under a higher pressure than the character mode in order to give more luster to an image.

Note that in the above embodiment, monocolor copying may be conducted with an arbitrary selection of one of the developers accommodating toners for color copying. In such a case, as is the case with the above embodiment, the amount of mold releasing oil to be applied may be changed between the case of copying with the toner for color copying and the case of copying with the toner for black-and-white copying.

In this embodiment, although the copying mode is switched manually, it may be switched automatically. For example, in the above embodiment, the mode may be switched automatically by determining the color information of image data read by the image reading device. If an additional function of forming images based on image data sent from a host computer or the like to the copying machine is provided, the copying mode may be switched automatically based on a determination of image data sent from such a host computer.

In the above described embodiment, a plurality of developing units containing toners having different amounts of offset preventing agent are provided in the body. However, the apparatus is not limited thereto, and the present invention may be applied to an image forming apparatus in which a developing unit can be exchanged. In that case, a plurality of developing units containing toners having different amounts of offset preventing agent are prepared, and identifying members are provided on respective developing units corresponding to the contained amount of offset preventing agent in the toners accommodated in respective developing units. When the operator exchanges the developing unit, the amount of contained offset preventing agent of the toner accommodated in the developing unit may be determined by the image forming apparatus based on the identifying member, which is mounted on the apparatus. The amount of application of the mold releasing agent to the fixing roller may be adjusted in accordance with the determined amount of offset preventing agent.

In the above embodiment, the state of the surface with respect to the fixing quality of the fixing surface of fixing device 39 changed by the amount of the mold releasing agent applied, but the invention is not limited to this method.

Figure 17:
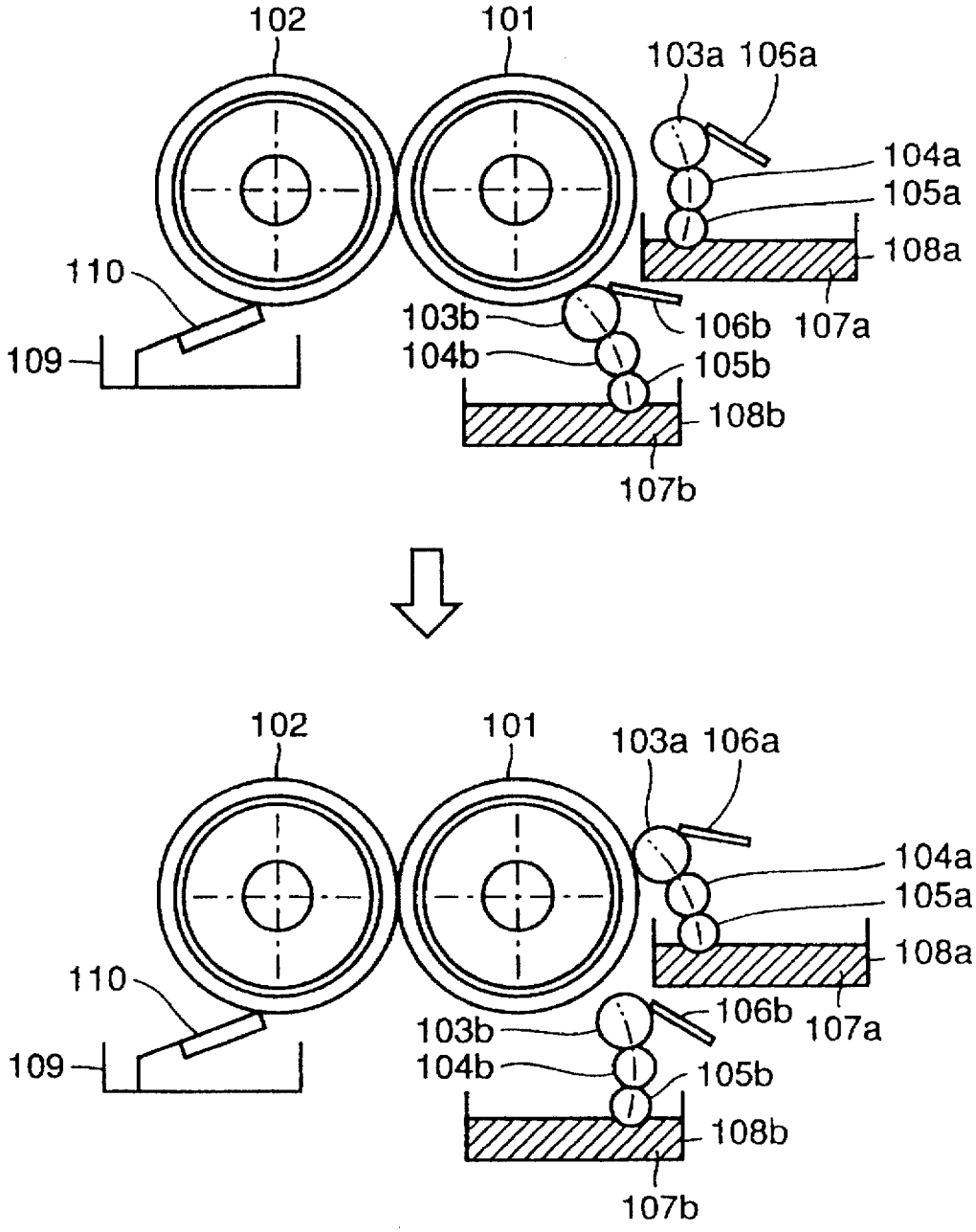

FIG. 17 shows an example with a different kind of mold releasing agent. As illustrated in FIG. 17, in this embodiment, two kinds of mold releasing agents **107*a* and 107*b*** having different mold releasing properties can be applied, and they are switched depending upon a mode selected based on the fixing property of a toner used.

Figure 18:
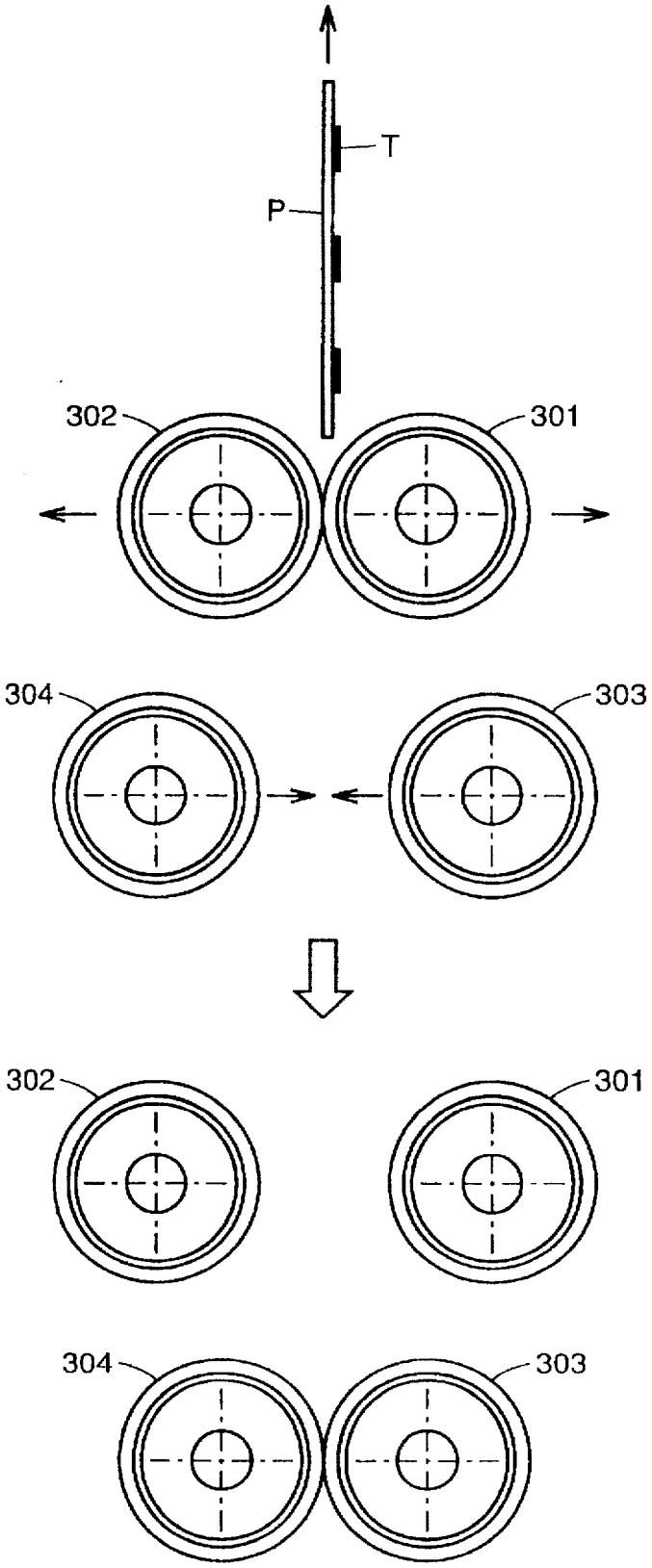

FIG. 18 shows a case with two kinds of fixing rollers 301 to 304 having different fixing properties are provided, and they are switched depending upon a copying mode selected based on the amount of an offset preventing agent in a toner.

For example, fixing rollers 301 are formed by covering an aluminum core metal with silicone rubber. An and oil application device for applying a mold releasing oil to fixing rollers 301 is disposed near fixing rollers 301 as shown in FIG. 4.

Fixing rollers 304 are formed by covering an aluminum core metal with PTFE. When the color copying mode is selected, toner image fixation is carried out by fixing rollers 301 while the mold releasing agent is applied to surface. When the white and black copying mode is selected, toner image fixation is carried out by fixing rollers 304.

The offset preventing agent includes a polyolefine based wax, such as a low molecular weight polyethylene wax, a low molecular weight oxidized polyethylene wax, a low molecular weight polypropylene wax, and a low molecular weight oxidized polypropylene wax, a higher fatty acid wax, a higher fatty acid ester wax, a Fischer-Tropsch wax, a candelilla wax, and a carnauba wax.

A resin used as a binder for a toner according to the present invention may be any resin which is generally used as a binder for a toner such as thermoplastic resin, such as polyethylene resin, poly(meta)acrylic based resin, polyolefine based resin, polyamid based resin, polycarbonate based resin, polyether based resin, polysulfone based resin, polyester based resin, epoxy based resin, and butadiene, or thermosetting resin such as urea resin, urethane resin or a copolymer, a block polymer, a graft polymer and a polymer blend thereof. The resin is not limited to the one with a complete polymer state such as thermoplastic resin, but the one containing oligomer, prepolymer, a cross linking agent or the like may be used.

If a toner according to the present invention is used in a high speed system, the toner must be fixed onto a transfer medium in a short period of time, and therefore a homopolymer or copolymer synthesized from stylene based monomer, (meta) acrylic monomer, (meta) acrylate based monomer or polyester based resin is preferably used as a binder resin.

In the binder resin, number average molecular weight Mn and volume average molecular weight Mw are such that $1000 \leqq Mn \leqq 10000$, and $20 \leqq Mw/Mn \leqq 70$, and more preferably $2000 \leqq Mn \leqq 7000$.

If the toner according to the present invention is used as a full color toner, a linear polyester resin having a glass transition point in the range from 55° to 70° C., a softening point in the range from 80° C. to 150° C., Mn in the range from 2000 to 15000, and a molecular weight distribution Mw/Mn of at most 3 is preferably used.

Note that the offset property of the toner changes not only depend upon the content of offset preventing agent but also on the property of such a binder resin.

The toner according to the present invention may be used as a magnetic toner, and in that case known magnetic fine particles are dispersed within the binder resin. The magnetic substance which may be used is a known magnetic substance such as a ferromagnetic metal, for example, cobalt, iron, and nickel, a metal alloy such as of cobalt, iron, nickel, aluminum, lead, magnesium, zinc, antimony, beryllium, bismuth, cadmium, calcium, manganese, selenium, titanium, tungsten and vanadium, a mixture and an oxide of these metals, and a baked substance (ferrite).

The average grain size of toner is preferably in the range from 5 to 15 μm, and it is preferably in the range from 5 to 9 μm and more preferably in the range from 5 to 8 μm particularly when a high definition image is reproduced. In particular, a toner with a grain size as small as 5–9 μm often suffers from a problem such as toner overlapping or density unevenness, but according to the present invention, a small grain size toner having an excellent property free from such a problem can be obtained.

The toner thus obtained may be used as a one component developer or a two-component developer together with a carrier.

For the carrier, any commonly used carrier-such as iron power carrier, ferrite carrier, coating carrier and binding carrier may be used.

Although the present invention has been fully described by way of examples with reference to the accompanying drawings, it is to be noted that various changes and modifications will be apparent to those skilled in the art. Therefore unless otherwise such changes and modifications depart from the scope of the present invention, they should be construed as being included therein.

What is claimed is:

1. An image forming apparatus comprising:

a first image forming device for forming a first image onto a recording medium with a first toner;

a second image forming device for forming a second image onto a recording medium with a second toner, wherein at least one of said first and second toners contains an offset preventing agent, and when both of the first and second toners contain the offset preventing agent, an amount of the offset preventing agent contained in the first toner is different from that of the offset preventing agent contained in the second toner;

a selecting device for selecting a first mode or a second mode, wherein the first image forming device forms the first image in the first mode and the second image forming device forms the second image in the second mode;

a fixing surface physically contacting the toner image on the recording medium to fix the image onto the recording medium, said surface selectably taking a first state or a second state which differs from the first state with respect to a fixing property; and a surface changing device for changing a condition of the surface in the first state or the second state according to the mode selected by the selecting device.

2. An image forming apparatus as claimed in claim 1, wherein the amount of the offset preventing agent contained in the first toner is larger than the amount of the offset preventing agent contained in the second toner, wherein the surface of the second state is higher than the surface of the first state in the fixing property, and wherein said surface changing device changes the condition of the surface into the first state when the first mode is selected and changes the condition of the surface into the second state when the second mode is selected.

3. An image forming apparatus as claimed in claim 2, wherein said second toner is free from the offset preventing agent.

4. An image forming apparatus as claimed in claim 3, wherein said first toner is colored in black and said second toner is colored in a color selected from the group of yellow, magenta and cyan.

5. An image forming apparatus as claimed in claim 1, wherein said offset preventing agent is a higher fatty acid wax, a higher fatty acid tester wax, a Fischer-Tropsch wax, a candelilla wax, carnauba wax and a polyolefine wax selected from the group consisting of low molecular weight polyethylene wax, low molecular weight polyethylene wax of oxidized type, low molecular weight polypropylene wax, low molecular polypropylene wax of oxidized type.

6. An image forming apparatus as claimed in claim 1, wherein said fixing surface is a surface of an endless member, said endless member being pressed to the recording medium in a predetermined pressure.

7. An image forming apparatus as claimed in claim 6, wherein said predetermined pressure of the endless member is changed according to the mode selected by the selecting device.

8. An image forming apparatus as claimed in claim 6, wherein said endless member is a roller.

9. An image forming apparatus as claimed in claim 6, which further comprises a heater for heating the endless member.

10. An image forming apparatus as claimed in claim 9, wherein said endless member is a film.

11. An image forming apparatus as claimed in claim 10, wherein said surface changing device varies power delivered to the heater according to the mode selected by the selecting device.

12. An image forming apparatus as claimed in claim 1, wherein said surface changing device comprises:

a coating device for coating a mold releasing agent on the fixing surface; and a controller for controlling the coating device to change a quantity of the mold releasing agent to be coated on the fixing surface so as to change the condition of the surface according to the mode selected by the selecting device.

13. An image forming apparatus as claimed in claim 12, wherein said controller comprises:

an accommodating device accommodating the mold releasing agent;

a supplying roller supplying the accommodated agent from the accommodating device to the fixing surface in accordance with a rotation of the roller; and a blade regulating the quantity of the releasing agent supplied by the roller in response to the mode selected by the selecting device.

14. An image forming apparatus as claimed in claim 13, wherein the blade changes its contact angle with respect to the roller in order to regulate the quantity of the releasing agent.

15. An image forming apparatus as claimed in claim 13, wherein the blade changes its contact pressure With respect to the roller in order to regulate the quantity of the mold releasing agent.

16. An image forming apparatus as claimed in claim 1, wherein said surface changing device comprises:

a coating device for coating a first mold releasing agent or a second mold releasing agent on the fixing surface, said mold releasing agents differing from each other with respect to a mold releasing property; and a controller for controlling the coating device to change the type of the mold releasing agent to be coated on the fixing surface so as to change the condition of the surface according to the selected mode.

17. An image forming apparatus comprising:

a first image forming device for forming a first image onto a recording medium with a first toner;

a second image forming device for forming a second image onto a recording medium with a second toner, wherein at least one of said first and second toners contains an offset preventing agent, and when both of the first and second toners contain the offset preventing agent, an amount of the offset preventing agent contained in the first toner is different from that of the offset preventing agent contained in the second toner;

a selecting device for selecting a first mode or a second mode, wherein the first image forming device forms the first image in the first mode and the second image forming device forms the second image in the second mode;

a first fixing surface to selectably contact the toner image on the recording medium to fix the image onto the recording medium;

a second fixing surface to selectably contact the toner image on the recording medium to fix the image onto the recording medium, a condition of said second fixing surface differing from a condition of the first fixing surface with respect to a fixing property; and a surface selecting device for selecting the first fixing surface or the second fixing surface to physically contact the toner image on the recording medium according to the mode selected by the selecting device.

18. An image forming apparatus as claimed in claim 17, which further comprises a coating device for coating a mold releasing agent on the second fixing surface, and wherein the first fixing surface is made of silicone rubber and the second fixing surface is made of polytetrafluoroethylene.

19. A method for fixing a toner image onto a recording medium, comprising the steps of:

forming a first toner image onto a recording medium in a first mode;

forming a second toner image onto a recording medium in a second mode, wherein at least one of said first and second toners contains an offset preventing agent, and when both of the first and second toners contain the offset preventing agent, an amount of the offset preventing agent contained in the first toner is different from that of the offset preventing agent contained in the second toner;

selecting the first mode or the second mode;

changing a state of a fixing surface with respect to a fixing property in response to the selected mode; and fixing the first or the second toner image onto the recording medium by the fixing surface.

20. An image forming apparatus comprising:

a first image forming device for forming a first image onto a recording medium with a first toner having a first fixing property;

a second image forming device for forming a second image onto a recording medium with a second toner having a second fixing property;

a selecting device for selecting a first mode or a second mode, wherein the first image forming device forms the first image in the first mode and the second image forming device forms the second image in the second mode;

a fixing surface physically contacting the toner image on the recording medium;

a coating device for coating a mold releasing agent on the fixing surface; and a controller for controlling the coating device to coat or to not coat the surface with mold releasing agent so as to change a fixing property of the surface according to the mode selected by the selecting device.

21. An image forming apparatus as claimed in claim 20, wherein said controller comprises:

an accommodating device accommodating the mold releasing agent;

a supplying roller supplying the accommodated agent from the accommodating device to the fixing surface by rotational motion of the roller; and a positioning device selectively positioning the roller at a first position, where the roller supplies the mold releasing agent to the fixing surface, or a second position, which inhibits the roller from supplying the mold releasing agent to the fixing surface.

22. A multi-color image forming apparatus comprising:

a first image forming device for forming a black image onto a recording medium with a black toner containing an offset preventing agent;

a second image forming device for forming a color image onto a recording medium with a yellow, magenta and cyan toner without offset preventing agent;

a selecting device for selecting a first mode or a second mode, wherein the first image forming device forms the black image in the first mode and the second image forming device forms the color image in the second mode;

a fixing surface physically contacting to the toner image on the recording medium to fix the image onto the recording medium, said surface selectably taking a first state or a second state which differs from the first state with respect to a fixing property; and a surface changing device for changing a condition of the surface into the first state or the second state according to the mode selected by the selecting device.

23. A multi-color image forming apparatus as claimed in claim 22 wherein said color image is formed by overlapping yellow image, magenta image and cyan image.

24. A multi-color image forming apparatus as claimed in claim 23, wherein said second image forming device forms a color image with a yellow, magenta, cyan and black toner without offset preventing agent.

25. An image forming apparatus comprising:

a first device forming a first toner image onto a recording medium in a first mode;

a second device forming a second toner image onto a recording medium in a second mode, wherein at least one of said first and second toners contains an offset preventing agent, and when both of the first and second toners contain the offset preventing agent, an amount of the offset preventing agent contained in the first toner is different from that of the offset preventing agent contained in the second toner;

a selector selecting the first mode or the second mode;

a fixing device fixing the first or the second toner image onto the recording medium; and a changing device changing a state of a fixing surface in response to the mode selected by the selector.

26. An image forming apparatus as claimed in claim 25, which further comprises:

a manual selector for selecting the first mode or the second mode for an operator to use said image forming apparatus.

27. An image forming apparatus as claimed in claim 25, which further comprises:

a determining device for automatically determining a mode to be selected by the selector.

28. An image forming apparatus as claimed in claim 27, wherein said image forming devices form the toner image according to an image data, and wherein said determining device determines a mode according to the image data.

29. An image forming apparatus as claimed in claim 27, wherein said determining device determines the mode according to the image forming device to be used for image forming.

30. An image forming apparatus comprising:

a first developing device which contains black toner containing an offset preventing agent;

a second developing device which contains colored toner being free from an offset preventing agent;

a mode selector by which an image forming mode is selected from either a first model where an image made by the black toner is formed on a recording medium, or a second mode, where an image made by the colored toner is formed on a recording medium;

a fixing device including a heated contacting surface which physically contacts the image on the recording medium to melt and fix the toner permanently on the recording medium; and a supplier which supplies a mold releasing agent on the surface, wherein an amount of said mold releasing agent supplied to the surface in the second mode is less than that supplied in the first mode.

31. The image forming apparatus as claimed in claim 30, wherein said supplier includes at least one feed roller, which contacts on the heated surface and feeds the mold releasing agent to the heated surface, and a blade, which is pressed against the feed roller, to regulate an amount of the mold releasing agent supplied to the heated surface.

32. The image forming apparatus as claimed in claim 31, wherein said blade is pressed against the heated surface at a first pressure in the first mode and at a second pressure in the second mode, and wherein the second pressure is greater than the first pressure.

33. The image forming apparatus as claimed in claim 31, further comprising:

a movable blade which is movable between a first position where the movable blade separates away from the heated surface and a second position where the movable blade contacts the heated surface, the first position and the second position in accordance with the image forming modes, wherein the movable blade is in the first position at the second mode and the movable blade is in the second position at the first mode.

34. The image forming apparatus as claimed in claim 30, wherein said supplier includes:

a plurality of feed rollers which are arranged in a row, one of said feed rollers located at the end of the row is dipped in a reservoir of mold releasing agent, another of said feed rollers located at the end of the row is contacted on the heated surface; wherein at least one of said rollers is shiftable between an operable position when the roller transfers the mold releasing agent from the reservoir to the heated surface and a non-operable position where the roller stops transferring the mold releasing agent from the reservoir to the heated surface.

* * * * *

UNITED STATES PATENT AND TRADEMARK OFFICE

CERTIFICATE OF CORRECTION

PATENT NO. : 5,732,316

DATED : March 24, 1998

INVENTOR(S) : Hiroyuki Yamasaki, et al.

It is certified that error appears in the above-indentified patent and that said Letters Patent is hereby corrected as shown below:

Column 12, line 52, delete "With" and insert --with--.

Column 15, line 15, delete "selected from either a first model" and insert --selected from either a first mode,--.

Signed and Sealed this

Fourteenth Day of July, 1998

Bruce Lehman

*Attest:*

BRUCE LEHMAN

*Attesting Officer*

*Commissioner of Patents and Trademarks*